US006193438B1

(12) United States Patent
Heims

(10) Patent No.: US 6,193,438 B1
(45) **Date of Patent: *Feb. 27, 2001**

(54) PAVER HAVING A CONVEYOR FOR LOADING A FOLLOWING PAVER

(75) Inventor: Dirk Heims, Bad Münder (DE)

(73) Assignee: ABG Allgemeine Baumaschinen-Gesellschaft mbH, Hameln (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/310,493

(22) Filed: May 12, 1999

(30) Foreign Application Priority Data

Dec. 5, 1998 (DE) ..... 198 21 091

(51) Int. Cl.[7] ..... E01C 19/18
(52) U.S. Cl. ..... 404/110; 404/101; 404/108
(58) Field of Search ..... 404/101, 108, 404/110

(56) References Cited

U.S. PATENT DOCUMENTS

| | | | | |
|---|---|---|---|---|
| 3,997,277 | * | 12/1976 | Swisher, Jr. et al. | 404/84.05 |
| 5,035,534 | * | 7/1991 | Brock et al. | 404/81 |
| 5,529,434 | * | 6/1996 | Swisher, Jr. | 404/108 |
| 5,735,634 | * | 4/1998 | Ulrich et al. | 404/102 |

FOREIGN PATENT DOCUMENTS

| | | |
|---|---|---|
| 3834313 A1 | 4/1990 | (DE) . |
| 297 15 467 U1 | 10/1997 | (DE) . |
| 297 12 038 U1 | 1/1998 | (DE) . |

* cited by examiner

*Primary Examiner*—Eileen D. Lillis
*Assistant Examiner*—Gary S. Hartmann
(74) *Attorney, Agent, or Firm*—Mark A. Ussai

(57) ABSTRACT

A paver (1) with a chassis (2) at the front in the paving direction, with a hopper (11) for receiving material to be paved and, at the rear, with a floating screed (5), two centrally arranged longitudinal conveyor devices (9,10) guided through a shaft (8) being provided between the hopper (11) and a distributor auger (7) located in front of the screed (5) in the paving direction, the hopper (11) being open relative to the longitudinal conveyor devices (9,10) and an additional conveyor device (33) for loading a hopper (12) of a following paver (13) being provided. One of the longitudinal conveyor devices (10) extends from the rear outlet of the shaft (8), beyond the screed (5) and to the additional conveyor device (33) and has a discharge end (14) which is fixed or adjustable to an appropriate height for loading the hopper (12). The longitudinal conveyor devices (9,10) are partitioned off from each other by a vertical separating plate (20).

20 Claims, 2 Drawing Sheets

PAVER HAVING A CONVEYOR FOR LOADING A FOLLOWING PAVER

The present invention relates to paving machines, and more particularly to paving machines having a hopper for receiving paving material from a loading vehicle.

Paving machines or "pavers" generally include a front-mounted hopper for receiving paving material and a rear-mounted screed which floats on the material to be paved. The screed is articulated on the chassis of the paver via tension arms. Paving material is deposited into the hopper by a separate "loading" vehicle and is conveyed from the hopper by means of a longitudinal conveyor device to a distributor auger located in front of the screed. The material is distributed over the paving width by the distributor auger and is paved or leveled by means of the screed.

The loading vehicle is placed in front of the paving vehicle and is pushed by the paver until all the material to be paved has been emptied into the hopper. The loading vehicle is then exchanged with another loading vehicle having a full load of paving material.

It is known, such as disclosed in German Patent No. DE 297 12 038 U1, to carry out "hot paving" of at least the two upper asphalt courses or layers in order to increase the degree of compaction and minimize the ageing of the binder present in a wearing course. Two pavers, traveling one behind the other in combination, are used in this case. So that the rear or following paver can be supplied with paving material from the front paver, an additional hopper and an additional conveyor device are mounted on the chassis of the "front" paver (i.e., front with respect to the paving direction). The additional hopper can be pivoted away laterally or in the direction of travel, so that the hopper of the front paver and the additional hopper can be alternately loaded by a loading vehicle. The additional conveyor device is used to convey paving material, as the front paver is performing a paving operation, from out of the additional hopper on the front paver and into a hopper of the rear or following paver. The additional conveyor device includes one or more conveyors connected one behind the other in succession and is guided laterally past the chassis or over and beyond the chassis. Such an additional conveyor system necessitates a considerable outlay in terms of construction.

The object of the invention is to provide a paver which has a simpler design for the supply of a following paver.

SUMMARY OF THE INVENTION

In one aspect, the present invention is a paver which is provided with two longitudinal conveyor devices guided through a shaft between a hopper and a distributor auger located in front of the screed in the paving direction and with an additional conveyor device for loading a hopper of a following paver, one of the longitudinal conveyor devices is extended at the outlet of the shaft beyond the screed to the additional conveyor device and is arranged, or is adjustable, with its discharge end at hopper loading height. This makes it possible to load a paver following is in the paving direction from the same hopper which serves for receiving material to be paved for the screed of the leading paver, so that there is no longer any need for an additional hopper. Moreover, a complicated lateral arrangement of the additional conveyor device is avoided and its design is simplified.

Preferably, the hopper of the front paver comprises two hopper halves which are each pivotable about an axis running adjacently to the longitudinal conveyor devices in the paving direction. Preferably, a lateral conveyor device arranged on the bottom side is provided in each of the hopper halves. The lateral conveyor makes it possible for two loading vehicles to move simultaneously one in front of each hopper half in each case, the hopper halves being emptied into the respective hopper halves located behind them.

BRIEF DESCRIPTION OF THE SEVERAL VIEWS OF THE DRAWINGS

The description of the invention below will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Figure 1:
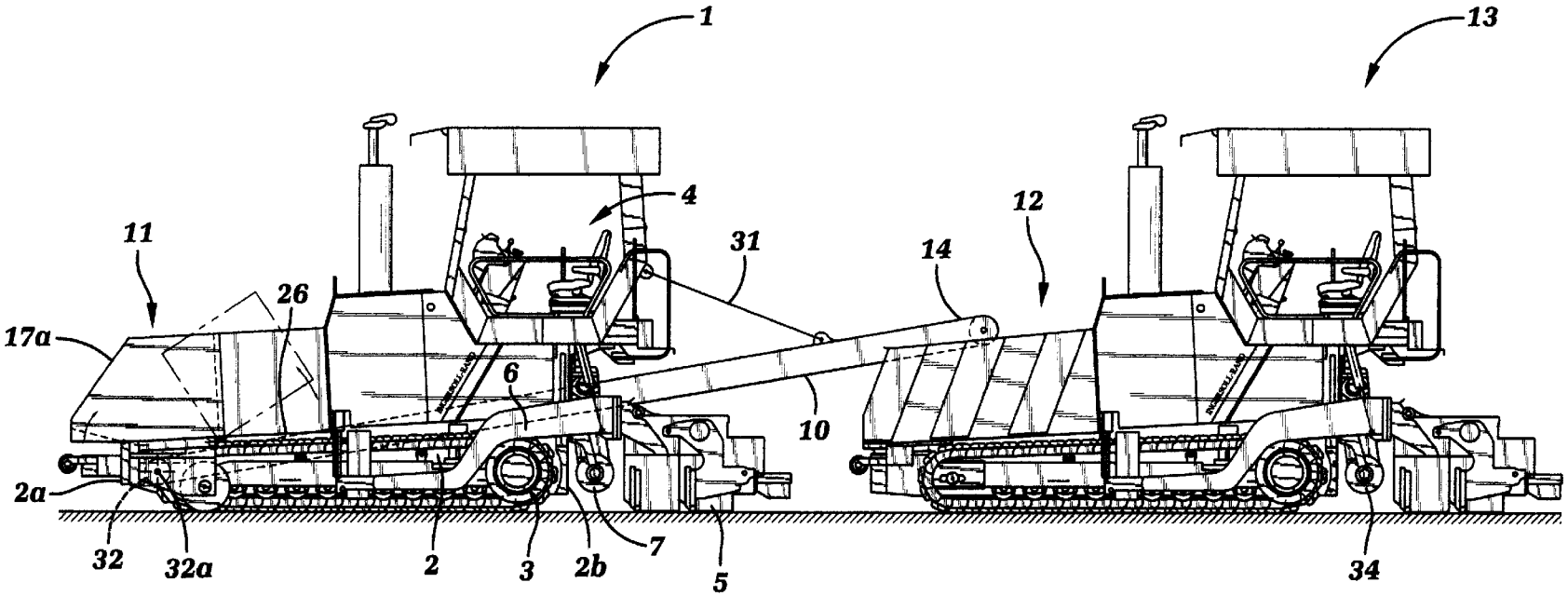
FIG. 1 is a side elevational view of two successive pavers in accordance with the present invention.

Certain terminology is used in the following description for convenience only and is not limiting. The words "right", "left", "lower", "upper", "upward", "down" and "downward" designate directions in the drawings to which reference is made. The words "front", "frontward" and "rear", "rearward" refer to directions toward and away from, respectively, a designated front section of a paver. The words "lateral", "laterally" and "longitudinal", "longitudinally" refer to directions generally perpendicular to and generally parallel with, respectively, a designated paving direction. The terminology includes the words specifically mentioned above, derivatives thereof, and words of similar import.

Figure 2:
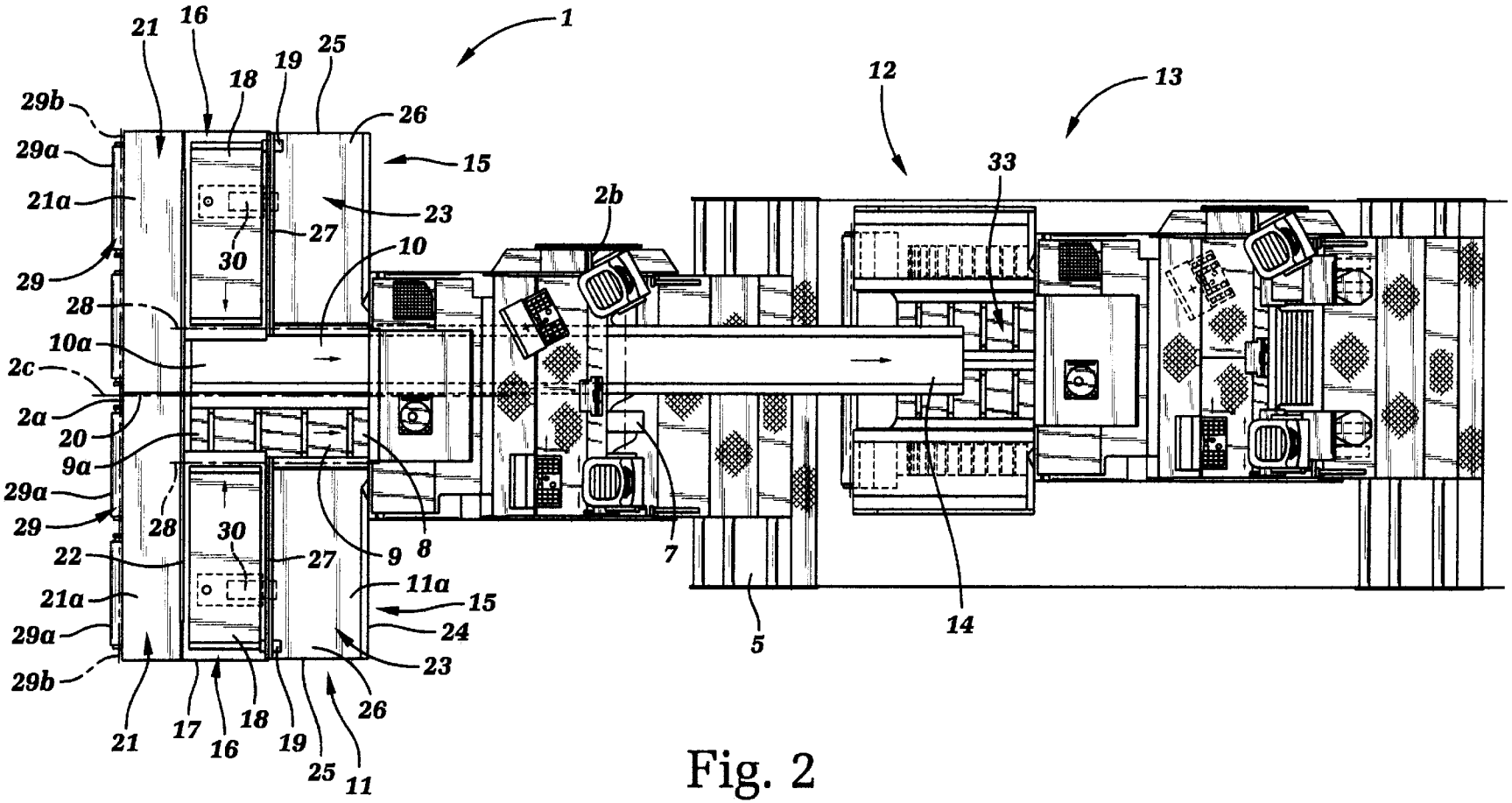
FIG. 2 is a top plan view of the two pavers shown in FIG. 1.

Referring now to the drawings in detail, wherein like numbers are used to indicate like elements throughout, there is shown in FIGS. 1 and 2 a presently preferred embodiment of a paver in accordance with the present invention. The paver is intended to operate in a combination of two pavers, a front paver and a rear paver. The front paver 1 comprises a chassis 2 having steerable traveling gear or locomotion means 3, preferably two wheel trains driving a continuous track or crawler, although separate wheels may be used. The paver 1 has a driver's cab 4 from which the paver 1 may be operated. A screed 5 is disposed at the rear of the paver 1, i.e., "rear" with respect to the paving direction, which floats on paving material and is articulated on or movably connected with the chassis 1 by a pair of tension arms 6.

A distributor auger 7 is located in front of the screed 5 (and behind the chassis 2) which distributes paving material across the width of the screed 5. Two longitudinal conveyor devices 9, 10 are disposed adjacent to each other and are disposed centrally on the chassis 2 of the front paver 1 so as to extend generally parallel with the paving direction. Further, the conveyors 9, 10 extend through a shaft 8 in the chassis 2 and extend from the distribution auger 7 and under the driver's cab 4 to a hopper 11 on the front side 2*a* of the chassis 2. The hopper 11 is open relative to the longitudinal conveyor devices 9, 10.

The longitudinal conveyor device 10 extends from the rear outlet of the shaft 8, beyond the screed 5 of the front paver 1, and to the hopper 12 of the rear or following paver 13. The longitudinal conveyor device 10 forms an additional conveyor device for the following paver 13. The longitudinal conveyor device 10 may either be fixed on the chassis 1 or may be adjustable, as long as a discharge end 14 of the conveyor 10 is at or positionable to an appropriate height to enable loading of paving material into the hopper 12 of the rear paver 13. To enable adjustability of the longitudinal conveyor device, the conveyor 10 may be movably suspended to the driver's cab 5 by appropriate means, such as by a cable 31, with the front end 10*a* of the conveyor 10 being pivotable about a generally horizontal axis 32*a* through a front roller 32 of the longitudinal conveyor device 10. The suspension of the longitudinal conveyor device 10 is preferably vertically adjustable for transport purposes.

The hopper 12 of the following paver 13 has essentially the same width as the overall width of the following paver 13 and includes two longitudinal conveyor devices 33 which extend uniformly as far as the associated distributor auger 34.

Preferably, the distributor auger 7 of the front paver 1 is offset centrally with respect to the chassis 2 in such a way that the longitudinal conveyor device 9 is arranged generally centrally with respect to (and generally perpendicularly to) the associated distributor auger 7 of the front paver 1.

The hopper 11 of the front paver 1 comprises two hopper halves 15, each hopper half 15 having a hopper bottom or base 15*a* and generally vertical side walls 15*b*.

Preferably, the hopper halves 15 each comprise a central section 16, with a side-wall portion 17 having a front-edge 17*a* angled in the paving direction so as to correspond to the maximum tipping angle of a loading vehicle and extending to the front end of the hopper 11. Each central section 16 has a lateral conveyor device 18 disposed on the bottom of the central section 16 and which extends between the outer lateral edge of the respective hopper half 15 and the front ends 9*a*, 10*a* of the longitudinal conveyors 9, 10, respectively. Preferably, the lateral conveyor devices 18 are each a continuous band type of conveyor disposed about and guided by means of rollers and are each driveable by a separate, appropriate drive 19, such as for example an electric or hydraulic motor. Alternatively, the conveyors 18 may be any other appropriate type of conveyor. By means of the lateral conveyor devices 18, paving material in the hopper 11 located either on the left and right adjacent to the longitudinal conveyor device 9 or on the right adjacent to the longitudinal conveyor device 10 is supplied to the longitudinal conveyor devices 9, 10. The longitudinal conveyor devices 9, 10 are separated from the front end of the hopper 11 by a vertical separating plate 20, since different materials are preferably being paved by the front paver 1 and the rear paver 13.

Further, the lateral conveyor devices 18 are preferably alternately driveable according to the measurement of vertical load on the hopper halves 15. In other words, only the conveyor 18 of the hopper half 15 inside of which a load of paving material is detected will be operated or driven. Control of the operation of the conveyors 18 may be carried out manually or automatically.

Each hopper half 15 further includes a front section 21, preferably formed of a bottom or base plate 21*a*, rotatably attached to the front edge of the adjacent central section 16 and extending generally horizontally and laterally between the sidewall portion 17 and the central axis 2*c* of the chassis 2. More specifically, the two front sections 21 extend transversely with respect to the paving direction over about half the width of the hopper 11 and are mounted to the central section 16 in an articulated or pivotable manner about an axis 22 that extends adjacent to the proximal lateral conveyor device 18. Each front section 21 is capable of being pivoted upwardly and generally rearwardly toward the adjacent lateral conveyor device 18 and, thus also towards the front ends of the longitudinal conveyor devices 9, 10, preferably by means of one or more hydraulic cylinders (not depicted) extending between the chassis 2 and the respective front section 21.

When either of the front sections 21 is pivoted upwardly (and rearwardly) toward the adjacent lateral conveyor 18, any paving material disposed on the front section 21 is deposited onto the particular lateral conveyor device 18 and/or onto the longitudinal conveyor devices 9, 10. Preferably, the front sections 21 are each connected with the adjacent central section 16 of the hopper half 15 so as to be located higher than or above the associated lateral conveyor devices 18, as best shown in FIG. 1, such that all paving material located on or in the front sections 21 is emptied from the section 11 and deposited onto the conveyor devices 9, 10, and/or 18.

Further, each hopper half 15 preferably includes a rear section 23 mounted behind the central section 16. Each rear section 23 comprises a rear wall 24, a side-wall portion 25 and a bottom or base portion 26. The rear sections 23 are each mounted in an articulated manner about an axis 27, running or extending adjacently to the respective lateral conveyor device 18 in its transport direction, and therefore likewise so as to be capable of being pivoted upwardly, for example by means of hydraulic cylinders (not illustrated), and toward the respective lateral conveyor device 18. By pivoting each rear section 23 upwardly toward the conveyor 18, essentially all paving material located in the rear section 23 is emptied from the rear section 23 and deposited onto the adjacent lateral conveyor device 18.

Preferably, the hopper halves 15 are each mounted on the chassis 2 of the front paver 1 in an articulated manner about an axis 28, running or extending adjacently to the longitudinal conveyor devices 9, 10 and parallel with the paving direction. With the described mounting arrangement, the hopper halves 15 are each capable of being pivoted upwardly, for example by means of one or more hydraulic cylinders (not illustrated). The pivotability of the hopper halves 15 enable each hopper half 15 to be pivoted upwardly and inwardly toward the central axis 2*c* of the chassis 2 into an essentially vertical storage position for transport purposes, so as to reduce the overall width of the front paver 1 when not in use, such as when the paver 1 is in transport.

The hopper 11 of the front paver 1 is arranged at a sufficient height above the pavement substrate, so that when the hopper halves 15 are completely pivoted upwardly to the vertical storage position, the hopper bottoms 15*a* do not come into contact with the pavement substrate or base surface.

Since the lateral conveyor devices 18 do not extend across the entire width of the hopper 11, but extend only to inner edge of the associated central section 16, the conveyors 18 and the conveyor drive units 19, each form a relatively small and correspondingly lightweight unit.

Two rotatable contact members 29 are arranged transversely to the paving direction. Each contact member 29 includes two rollers 29*a* and is mounted on the hopper carrier structure below the respective bottom 15*a* of the hopper half 15 and at the front end 2*a* of the chassis 2 (i.e., beneath the front section 23). The contact members 29 are each mounted rotatably about a rotational axis 29*b* extending axially between the two rollers 29*a*. A loading vehicle traveling backwards toward one of the hopper halves 15 of the front paver 1 comes into contact with the respective contact member 29, whereupon loading can commence. The contact members 29 are pivotable upwards together with the hopper halves 15 for transport purposes.

To load the paver 1, a loading vehicle loaded with paving material is reversed in front of one of the hopper halves 15 and emptied into the respective hopper half 15. As a result of the upward pivoting of the front sections 21 and/or of the rear sections 23, paving material located in the hopper half 15 is supplied to the longitudinal conveyor devices 9, 10. By means of the longitudinal conveyor device 9, the paving material supplied is conveyed rearwardly in a direction opposite to the paving direction to the distributor auger 7 of the front paver 1, so as to be distributed over the paving width by the distributor auger 7 and paved by means of the screed 5.

Preferably, at least one supporting wheel 30 is arranged below the each lateral conveyor device 18. The supporting wheels 30, in conjunction with pivotability about the axes 28, ensure statically satisfactory vertical-load conditions, regardless of any unevenness in a pavement substrate, and preferably have trailing properties. The supporting wheels 30 may be provided with their own drive and/or may be regulatable in a load-dependent manner in terms of their torque.

Even if the hopper 11 does not include separate stop means to limit the pivotability of the hopper halves 15 downwards about the axes 28 and toward the pavement substrate, the supporting wheels 30 provide satisfactory vertical-load conditions, regardless of any unevenness in the pavement substrate. The paver may include crawler running gears or crawlers (not depicted) instead of or in addition to the supporting wheels 30.

Further, the hopper 11 of the front paver 1 may also include one or more traveling gears or locomotion means, such as for example in the form of supporting rollers, wheels or crawlers, connected with and extending below the underside of the hopper 11, so that the hopper 11 may be transported as a separate unit independently of the paver 1.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

Having described the invention, what is claimed is:

1. A paver (1) with a chassis (2) having a front end and a rear end with respect to a paving direction, a first hopper (11) for receiving material to be paved disposed at the front end of the chassis (2), a floating screed (5) connected with the rear end of the chassis (2), a distributor auger (7) located in front of the screed (5), first and second centrally arranged longitudinal conveyor devices (9, 10) guided through a shaft (8) in the chassis (2), the shaft (8) being located between the hopper (11) and the distributor auger (7) and having an inlet and an outlet, the hopper (11) being open relative to the longitudinal conveyor devices (9, 10), wherein the second longitudinal conveyor device (10) extends from the outlet of the shaft (8) and beyond the screed (5) so as to he configured to load a second hopper (12) of a following paver (13), the second longitudinal conveyor device (10) having a discharge end (14) arranged at a hopper loading height, the first and second longitudinal conveyor devices (9, 10) being partitioned from one another by a vertical separating plate (20).

2. The paver according to claim 1, wherein the second longitudinal conveyor device (10) has a front end disposed about a deflectable roller (32), the roller (32) having an axis, the loading conveyor (10) being pivotable about the axis of the roller (32).

3. The paver according to claim 2, wherein the chassis (2) further includes a driver's cab and the second longitudinal conveyor device (10) is suspended on the driver's cab.

4. The paver according to claim 3, wherein the second longitudinal conveyor device (10) is suspended so as to be vertically adjustable.

5. The paver according to claim 1, wherein the distributor auger (7) is offset centrally in such a way that the first longitudinal conveyor device (9) is arranged centrally with respect to the distributor auger (7).

6. The paver according to claim 1, wherein the first hopper (11) comprises two hopper halves (15) which are each pivotable about a separate axis (28), each axis (28) running adjacently to a separate one of the first and second longitudinal conveyor devices (9, 10) and generally along the paving direction.

7. The paver according to claim 6, wherein each of the hopper halves (15) includes a bottom side and the paver further includes two lateral conveyor devices (18) each lateral conveyor device (18) being driveable by a drive (19), is disposed on the bottom side of a separate one of the hopper halves (15), and extends to a separate, proximal one of the first and second longitudinal conveyor devices (9, 10), and each of the bottom sides of the hopper halves (15) includes at least one tiltable bottom portion that is tiltable relative to the lateral conveyor device (18) disposed on the bottom side.

8. The paver according to claim 7, wherein each of the hopper halves (15) includes a tiltable bottom portion (26) located at a rear side, with respect to the paving direction, of the lateral conveyor device (18) disposed in the hopper half (15), the tiltable bottom portion (26) being pivotable forwardly about an axis (27) running adjacently to the lateral conveyor device (18) with respect to a transport direction of the lateral conveyor device (18).

9. The paver according to claim 7, wherein each of the hopper-halves (15) includes a tiltable bottom portion (21) located at a front side, with respect to the paving direction, of the lateral conveyor device (18) disposed in the hopper half (15) and is pivotable rearwardly about an axis (22) running adjacently to the lateral conveyor device (18) with respect to a transport direction of the lateral conveyor device (18).

10. The paver according to claim 7, wherein the tiltable bottom portion of each of the hopper halves (15) is actuatable by hydraulic cylinders.

11. The paver according to claim 7, wherein at least one traveling gear(30) is arranged on each of the hopper halves (15) below the lateral conveyor devices (18).

12. The paver according to claim 11, wherein each of the traveling gears (30) have trailing properties.

13. The paver according to claim 11, wherein each of the traveling gears (30) has a separate drive.

14. The paver according to claim 13, wherein each of the traveling gears (30) is regulatable in a load-dependent manner in terms of torque.

15. The paver according to claim 11, wherein each of the traveling gears (30) comprise at least one supporting wheel.

16. The paver according to claims 11, wherein the traveling gears (30) comprise in each case at least one crawler traveling gear.

17. The paver according to claim 11, wherein the paver (1) further includes hopper carrier structure and the hopper halves (15) are each mounted on the carrier structure in an articulated manner so as to be pivotable about an axis (28) running adjacently to the first and second longitudinal conveyor devices (9, 10) in the paving direction.

18. The paver according to claim 6, wherein each of the hopper halves (15) can be pivoted upwards in a transport position about an axis (28) running adjacently to the longitudinal conveyor devices (9, 10) in the paving direction.

19. The paver according to claim 7, wherein the lateral conveyor devices (18) are alternately driveable according to a measurement of vertical load.

20. The paver according to claim 1, wherein the first hopper (11) (1) is arranged removably as a unit on the paver (1).

* * * * *